United States Patent [19]

Brake

[11] Patent Number: 4,498,814

[45] Date of Patent: Feb. 12, 1985

[54] RELEASABLE ANCHOR CONNECTOR FOR TENSION LEG PLATFORM

[75] Inventor: Arthur L. Brake, Winscombe, England

[73] Assignee: Vickers PLC of Vickers House, London, England

[21] Appl. No.: 418,011

[22] Filed: Sep. 14, 1982

[30] Foreign Application Priority Data

Sep. 18, 1981 [GB] United Kingdom ..... 8128307

[51] Int. Cl.[3] ..... B63B 21/50

[52] U.S. Cl. ..... 405/224; 405/195; 405/169

[58] Field of Search ..... 405/224, 195, 169, 170; 166/349, 340, 181, 182, 123, 125, 322

[56] References Cited

U.S. PATENT DOCUMENTS

| | | | |
|---|---|---|---|
| 2,178,844 | 11/1939 | Baker | 166/182 X |
| 2,671,512 | 3/1954 | Ragan et al. | 166/182 X |
| 3,163,228 | 12/1964 | Hayes | 166/349 X |
| 3,189,099 | 6/1965 | Ottemann et al. | 166/340 X |
| 3,199,906 | 8/1965 | Chenoweth | 166/125 X |
| 3,536,344 | 10/1970 | Nelson | 166/340 X |
| 4,354,446 | 10/1982 | Goldsmith et al. | 405/224 X |

*Primary Examiner*—Dennis L. Taylor

*Attorney, Agent, or Firm*—Oblon, Fisher, Spivak, McClelland & Maier

[57] ABSTRACT

A releasable anchor connector for a tension leg platform in which a tether with a bore is locked in a template insert at the seabed by means of a series of locking fingers acting through a ring and a resilient connector. The tether is unlocked by locating a ram that disengages the fingers at the end of the bore and applying hydraulic pressure to the ram by means of a hose passed down the bore and a delivery head at the end of the hose. The delivery head comprises a hollow body, a piston slidable in the body and a valve member slidably mounted on the piston. A spring urges the valve member to engage a valve seat and a spring urges the piston forwards. Hydraulic pressure of the fluid in the hose forces the piston back so that a split collet moves back with the piston and expands to hold the delivery head in the position behind a shoulder formed in a bore leading to the ram, after which the piston lifts the valve member off its seat, so transmitting the hydraulic pressure to the ram. The springs close the valve as the hydraulic pressure is released.

8 Claims, 3 Drawing Figures

RELEASABLE ANCHOR CONNECTOR FOR TENSION LEG PLATFORM

BACKGROUND OF THE INVENTION

The present invention relates to releasable anchors for semi-submersible vessels for offshore drilling and in particular to the disengagement of the tethers which fasten tension leg platforms to the sea bed.

A tension leg platform is a semi-submersible vessel which is anchored by means of a number of tethers tensioned against the natural buoyance of the vessel. Each tether comprises a hollow drill string with an anchor connector at its lower end for locking into a template fastened to the sea bed. It is necessary for the anchor connector to be releasable from the template, and for this to be controlled from the vessel, so that the lower connector may be serviced or the vessel moved to a new location.

The anchor connector is generally released by disengaging the mechanical locking mechanism using hydraulic pressure transmitted down the bore of the tether. However, it has been found that in some instances, for example when the connector has been in the locked position for some years the pressure necessary to unlock the locking mechanism is so great that it causes permanent damage to the joint between the tether and the anchor connectot. This is clearly undesirable.

SUMMARY OF THE INVENTION

It is an object of the present invention to provide a system which ensures the release of the anchor connector without damage to the joint.

According to the present invention there is provided a releasable tether connector for mooring a tension leg platform comprising an anchoring member secured to the sea bed, a tether extending between the platform and the anchoring member and having means therein defining a hollow central first bore, latching means attached at the lower end of the tether line and arranged releasably to fasten to the anchoring member, a ram within said latching means arranged on supply of fluid thereto to release said latching means from said anchoring member, portions of said latching means defining a second bore that communicates said ram with the first bore, said second bore having portions defining an inwardly projecting shoulder, a fluid supply line to be passed down said bore in said tether, a delivery head connected at the tip of the supply line that descends to a working position in said second bore, sealing means that fluid-tightly seals the delivery head to the second bore when the delivery head is in its working position to confine the pressure of the fluid below the delivery head, and locking means in the delivery head that expands behind the shoulder in response to passage of fluid down said supply line to hold the delivery head in its working position while fluid is fed under pressure into said ram to release said latching means.

The hydraulic pressure may be supplied to the delivery head via a flexible hose, and the delivery head is arranged to lock in position before pressure is applied to the locking mechanism. Preferably, when the pressure is released, the delivery head is arranged to release itself from its locked position so that it may be withdrawn.

According to another aspect of the present invention, a delivery head for use in unlocking the anchor connector of a tether e.g. for a tension leg platform from a template on the sea bed comprises a hollow body, a piston slidably mounted within the body, a valve member slidably mounted on the piston and first biassing means arranged to urge the valve member against a valve seat in the closed position, the piston being arranged to slide in the body as hydraulic pressure is applied to the delivery head, thereby lifting the valve member off the valve seat to open the delivery head.

Preferably, the delivery head includes second biassing means arranged to return the piston upon release of the pressure. Preferably, the delivery head includes locking fingers connected to the piston and arranged to move to a locking position as the piston slides in response to the hydraulic pressure. In the locked position the fingers may engage a shoulder on the inner wall of a bore leading to the ram.

The invention may be carried into practice in various ways and one embodiment will now be described by way of example.

DETAILED DESCRIPTION OF PREFERRED EMBODIMENT

Figure 1:
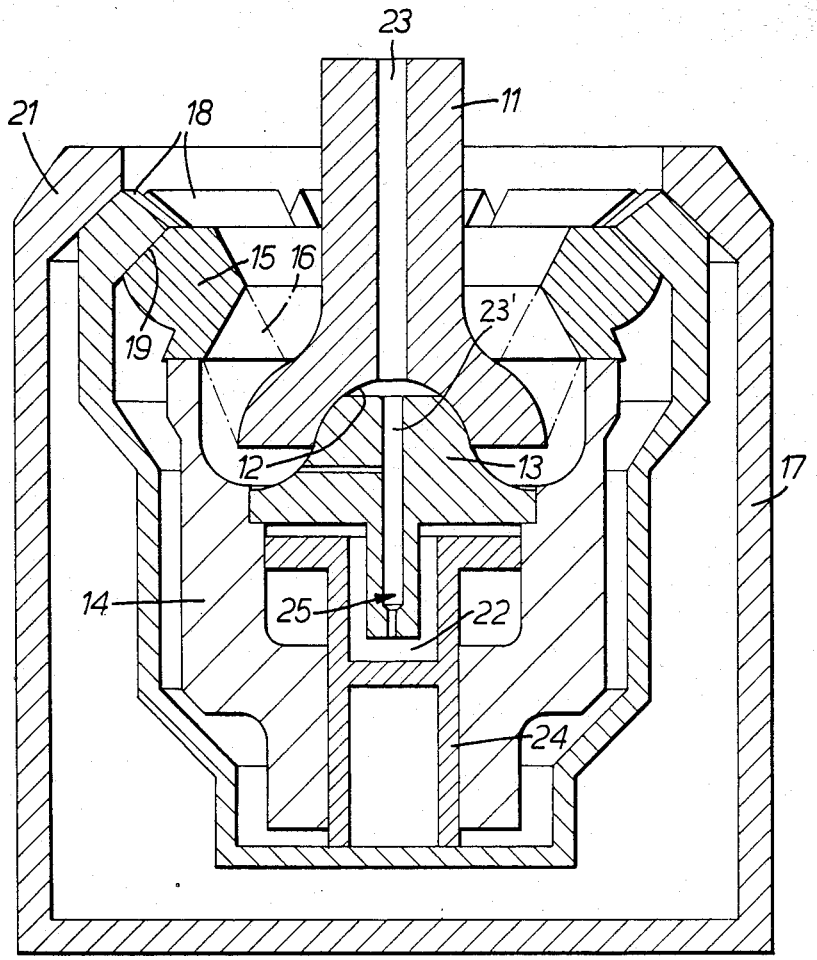
FIG. 1 is a simplified vertical section through an anchor connector.

FIG. 1 shows an anchoring connector for a tether 11. The tether 11 has, at its lower end, a part-spherical concave surface 12, in sliding contact with a corresponding part-spherical seat 13 mounted in an anchor body 14. A flexible joint in the form of a generally annular body or ring 15 is mounted on the lower end of the tether through a compressible portion 16 shown in broken lines. These are located within a template insert 17 which is located in a template (not shown) itself fixed to the sea bed. The flexible joint is locked in position by means of a number (in this case, eight) of fingers 18, which in the locked position, as shown, are wedged between an inclined surface 19 on the ring 15 and an inwardly extending lip 21 on the insert 17. The relative positions shown in FIG. 1 are maintained by the tether 11 being under tension.

In order to release the anchor connector, the tension in the tether 11 is first released. This releases the pressure between the ring 15, the fingers 18 and the lip 21. It has then been customary to apply hydraulic pressure e.g. about 1000 psi to a pressure chamber 22 via the bore 23 of the tether 11. This tends to force a pressure transmitting member 24 down, so drawing with it the fingers 18 which slide down the inclined surface 19.

This procedure, however is not always successful, for example, if the fingers 18 become stuck. It is not possible to increase the pressure beyond a certain value since this tends to damage the joint, and in particular the flexible seal 16. Furthermore, the pressure can then escape.

Figure 2:
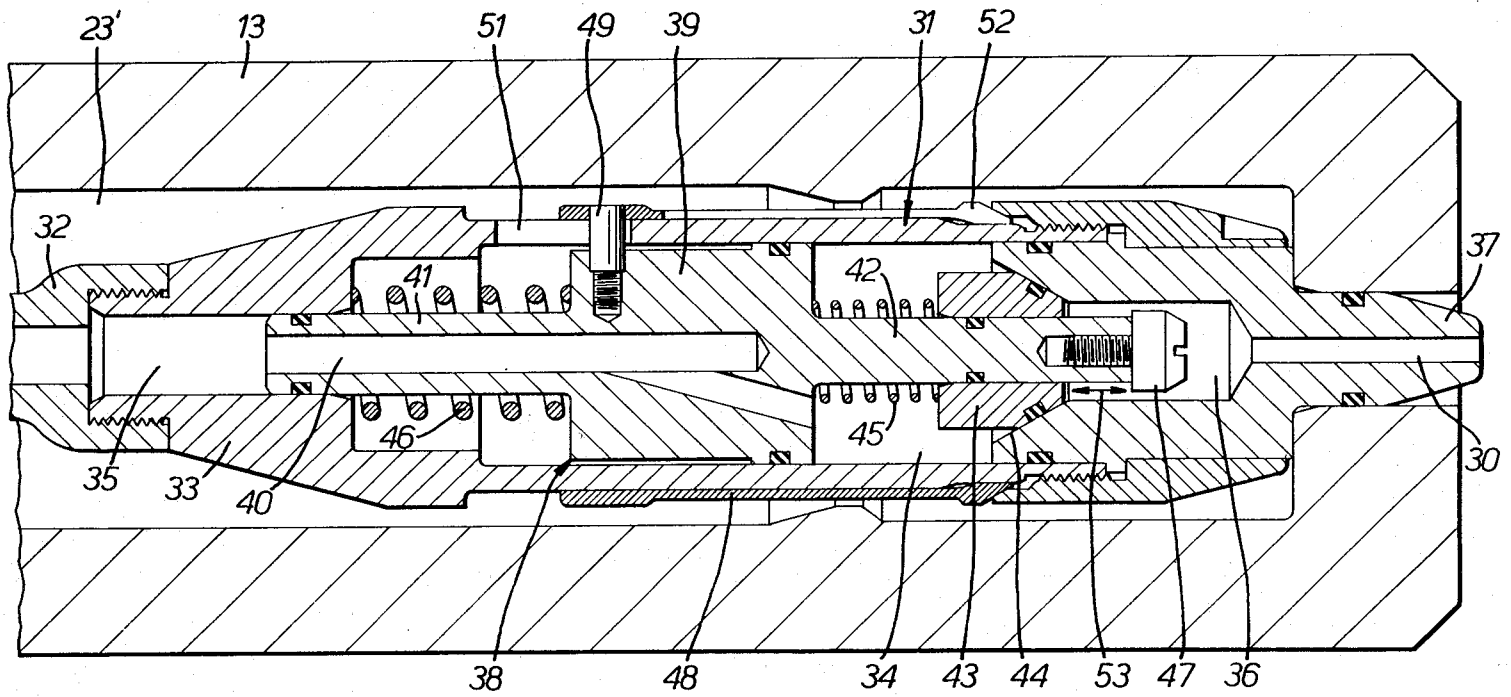
FIG. 2 is a section through a delivery head in the closed position for use with the connector in FIG. 1 in accordance with the invention.
Figure 3:
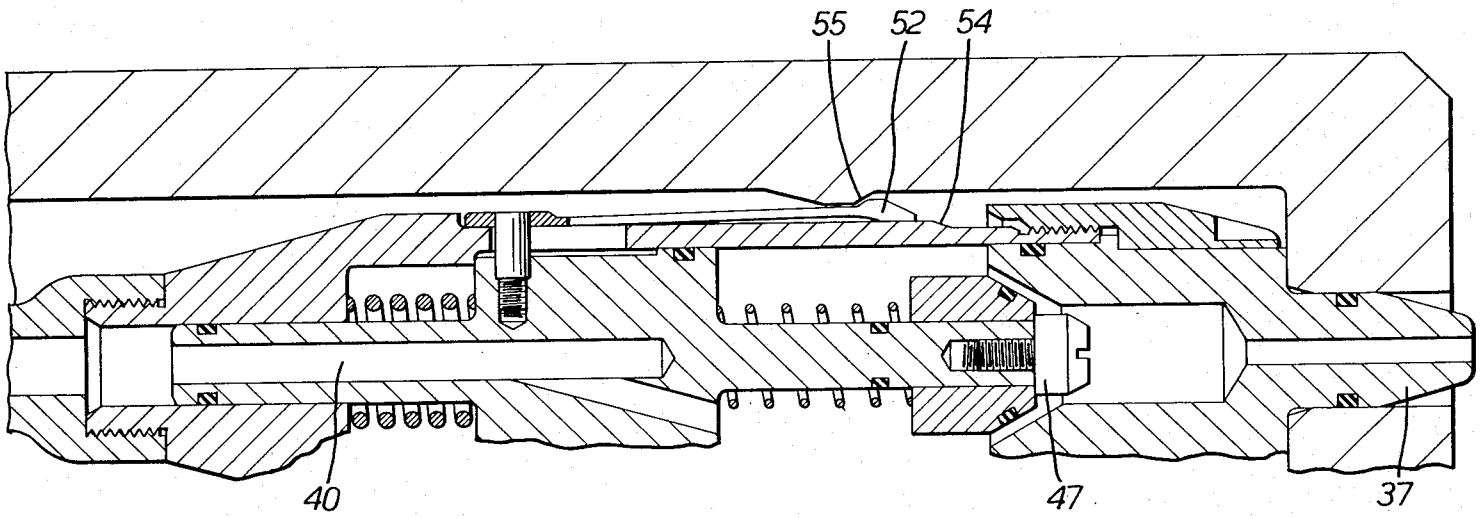
FIG. 3 is a part section similar to FIG. 2, with the delivery head in the open position.

To avoid this problem, a delivery head 31 shown in FIGS. 2 and 3 is inserted into the bore 23 by means of a flexible hose 32, and is pushed right to the end.

The delivery head 31 comprises a hollow body 33 whose cavity is comparatively wide over the central portion 34 but has two narrower bores 35, 36 at the rear and front ends respectively. The front of the body 33 extends into a probe 37 which has a narrow bore 30 in communication with the cavity.

A piston 38 is slidably mounted within the cavity. The piston 38 has a wide central portion 39 which slides on the inner surface of the body 33, a narrow rear portion 41 which slides in the rear bore 35, and a narrow front portion 42 which extends into the front bore 36. The rear portion 41 has a bore 40 which extends from the rear of the piston 38 to that part of the central cavity portion 34 in front of the piston central portion 39.

A valve member 43 is slidably mounted on the piston front portion 42 and is arranged to sealingly engage a seat 44 formed within the valve body 33. A spring 45 urges the valve member 43 on to the valve seat 44 and a spring 46 urges the piston 38 forwards.

A stop 47 is mounted at the forward end of the piston front portion 42 and a split collet 48 is attached to the piston 38 by means of pins 49. The collett 48 extends forward on the outside of the delivery head body, 33, with the pins 49 extending through slots 51 in the body 33. In its forward end, the collet is formed with a widened portion 52.

To operate the delivery head 31, it is first passed along the bore 23 of the tether 11 until it is in the position shown at 25 in FIG. 1, with the probe 37 snugly located a narrow delivery port at the end of the bore 23', as shown in FIG. 2. Tension in the tether line 11 is relaxed so that the tether line 11 and the anchor body 14 move a short distance inwardly of the anchoring chamber 17 thereby disengaging fingers 18 from the lip 21 and freeing them to slide over the inclined surface 19. Hydraulic fluid at a high pressure (e.g. 3000 psi) is then forced down the flexible hose 32 and into the delivery head. The pressure is transmitted via the bore 40 to the front part of the cavity central portion 34. This forces the piston 38 backwards against the spring 46, however, the valve member 43 is retained in position against its seat 44 by the spring 45. When the lost motion 53 has been taken up, further movement causes the stop 47 to contact the valve member 43, lifting it from the seat 44, so opening the valve. This allows the high pressure to be exerted upon the pressure transmitting member 24 and so to move the fingers 18.

At the same time, the collett 48 is moved back with the piston 38 and rides up over a shoulder 54 on the outside of the delivery head body 33 and engages a shoulder 55 on the inside of the bore 23', thus locking the delivery head in position. This position is shown in FIG. 3. When the fingers 18 have been released, the high pressure is released and the springs 45, 46 return the delivery head to the closed position shown in FIG. 2.

If the delivery head is inserted incorrectly with the probe 37 insufficiently far along the bore 23', when the high pressure is applied, its position will not be able to be maintained, since the fluid will pass into the bore 23 and the operator will be thus alerted. The delivery head will then be inserted again and the pressure applied.

It will therefore be appreciated that by using the delivery head as described above, damage to the flexible seal 16 can be avoided, while at the same time ensuring that the anchor connector may be released.

Although the invention has been described with reference to tension leg platforms, it will be appreciated that it is applicable to anchor connectors used in other application.

Obviously, numerous modifications and variations of the present invention are possible in the light of the above teachings. It is therefore to be understood that within the scope of the appended claims, the invention may be practiced otherwise than as specifically described herein.

What is claimed as new and desired to be secured by Letters Patent of the United States is:

1. A releasable tether connector for mooring a tension leg platform, comprising:

an anchoring member secured to the sea bed;

a tether extending between the platform and the anchoring member and having means therein defining a hollow central first bore;

latching means attached at the lower end of the tether line, said latching means being constructed and arranged so as to be releasably fastened to the anchoring member;

a ram within said latching means, said ram being operative to release said latching means from said anchoring member in response to a supply of fluid to said ram;

portions of said latching means defining a second bore that communicates said ram with the first bore, said second bore having portions defining an inwardly projecting first shulder;

a fluid supply line adapted to be passed down said first bore in said tether;

a delivery had connected at a tip of the supply line that descends to a working position in said second bore;

sealing means that fluid-tightly seals the delivery head to the second bore when the delivery head is in said working position, so as to confine the pressure of the fluid to below the delivery head in a fluid flow direction; and locking means in the delivery head, said locking means adapted to expand at a position upstream from said shoulder in response to passage of fluid through said supply line, said expanded locking means engaging said shoulder for holding the delivery head in said working position while fluid is fed under pressure into said ram to release said latching means.

2. A connector according to claim 1, wherein:

the anchoring member includes an anchoring chamber having a mouth of a restricted size;

the latching means is an anchor body that passes into the anchoring chamber and has wedging means thereon, a flexible connector connecting the anchor body to the tether line and a locking member having a series of first fingers surrounding the anchor body and movable axially relative thereto when tension on said tether line is released, said fingers being movable between a release position in which the first fingers are retracted and can pass through the mouth of the anchoring chamber and a locking position in which the first fingers are held expanded by the wedging means so that the locking member and the anchor body cannot pass through the mouth of the anchoring chamber;

the ram is defined by a piston mounted on one of said anchor body and locking member and a cylinder on the other of said anchor body and locking member; and said second bore is in a member mounted on said anchor body.

3. A connecting according to claim 2, wherein the lower end of the tether has a part spherical concave surface in sliding contact with a corresponding part spherical seat mounted on the anchor body, the second bore having an opening at said part spherical seat for communication with said first bore.

4. A connector according to claim 1, wherein the delivery head comprises a hollow body, a piston slidably mounted in the hollow body, second locking fingers comprising said locking means and connected to said piston, a valve member slidably mounted on the piston, a stop mounted on said piston for permitting a limited lost motion therebetween, a valve seat against which the valve member seals and first biasing means arranged to urge the valve member against the valve seat, whereby the valve member is moved by the piston after said lost motion has been taken up so that when fluid is supplied to the delivery head the second locking fingers engage the first shoulder to hold the delivery head in said working position after which the valve member is lifted from the seat to admit fluid to the ram.

5. A connector according to claim 4, wherein the second locking fingers surround the hollow body and are connected to the delivery head piston so as to slide along the exterior surface of the body as the delivery head piston moves, a supply of fluid to the delivery head causing the piston to move the second locking fingers over a second shoulder on the exterior surface of the body so as to expand the second locking fingers so that they latch with the first shoulder.

6. A connector according to claim 4, wherein the delivery head further comprises second biasing means arranged to return the piston and second locking fingers when fluid pressure is released.

7. A connector according to claim 6, wherein the piston is formed with a bore communicating the fluid supply line with a downstream face of said piston so that a supply of fluid to the delivery head moves the piston upwardly.

8. A connector according to claim 7, wherein the downstream end of the delivery head is formed with a nozzle that engages a port of reduced diameter at the lower end of said second bore, said sealing means sealing between the nozzle and the port.

* * * * *